US005564729A

United States Patent [19]

Gomez et al.

[11] Patent Number: 5,564,729

[45] Date of Patent: Oct. 15, 1996

[54] SNOWBOARD SUPPORT AND TETHER

[76] Inventors: Anthony A. Gomez; Rhonda J. Gomez, both of 1364 Thermal Ave., San Diego, Calif. 92154

[21] Appl. No.: 420,732

[22] Filed: Apr. 11, 1995

[51] Int. Cl.[6] ..... A63L 11/00

[52] U.S. Cl. ..... 280/637; 280/809; 280/814

[58] Field of Search ..... 280/809, 816, 280/637, 14.2, 814; 297/423.39, 423.4, 485, 423.12, 423.17; 441/75

[56] References Cited

U.S. PATENT DOCUMENTS

| | | | |
|---|---|---|---|
| 2,877,833 | 3/1959 | Boles | 297/485 |
| 3,062,585 | 11/1962 | Bentley | 297/485 |
| 4,556,252 | 12/1985 | Serex | 280/809 |
| 4,940,255 | 7/1990 | Donine | 280/809 |
| 5,026,088 | 6/1991 | Stuart | 280/14.2 |
| 5,145,202 | 9/1992 | Miller | 280/14.2 |
| 5,194,026 | 3/1993 | Corwin et al. | 280/816 |
| 5,397,171 | 3/1995 | Leach | 297/485 |

*Primary Examiner*—Richard M. Camby
*Attorney, Agent, or Firm*—Dennis H. Lambert, Esq.

[57] ABSTRACT

A combined tether and support for a snowboard includes an adjustable support strap that is releasably connected at its upper end to a harness worn on the body of the user and releasably connected at its lower end to a snowboard to support the weight of the snowboard when the user is riding a chair lift. A short tether extends between the support strap and a lower leg portion of the user to tether the snowboard to the user when the snowboard is being ridden. Adjustment of the length of the support strap enables the user to ride the snowboard normally when the strap is lengthened, and supports the weight of the snowboard when the strap is shortened and the user is sitting on a chair lift. Quick-connect couplings are provided between the support strap, snowboard and harness.

20 Claims, 4 Drawing Sheets

SNOWBOARD SUPPORT AND TETHER

TECHNICAL FIELD

This invention relates generally to the sport of snowboarding. More specifically, the invention relates to a combined tether and means for supporting the weight of a snowboard while riding a chair lift or the like.

BACKGROUND ART

Snowboarding is a relatively new sport that is growing rapidly in popularity. It combines some of the skills and techniques of both snow skiing and surf boarding, i.e., a snowboard is constructed and shaped similarly to a surfboard, although smaller, and has bindings similar to those used to secure skis to the feet of the user and is used similarly to the way a single ski would be used to ski on snow.

For safety and convenience, the snowboard is tethered to the leg of the snowboarder by a short strap or tether that remains attached when the snowboard is being ridden as well as when the snowboarder is riding a chair lift back to the top of a slope. This tether serves to support and suspend the snowboard from the leg of the snowboarder while riding the chair lift, and serves to secure the snowboard to the snowboarder and prevent it from sliding uncontrolled down a slope in the event of a fall.

Snowboards are relatively heavy, however, weighing as much as twenty pounds or more, and exert considerable force on the leg of the snowboarder while riding a chair lift. During the course of a day, this weight leads to fatigue and soreness and reduces enjoyment of the sport.

Accordingly, there is need for a device that will not only tether a snowboard to the snowboarder for reasons of safety while the snowboard is being ridden, but that will also serve to support the snowboard in a way to prevent fatigue when the snowboarder is riding a chair lift or the like.

DISCLOSURE OF THE INVENTION

The present invention provides a unique means for tethering a snowboard to the leg of a snowboarder during use, and which also supports the snowboard in a way to prevent fatigue to the leg of the snowboarder while riding a chair lift or the like.

The tethering means of the invention comprises either a separate harness which may be worn and which transfers the weight of the snowboard to the waist and upper body of the user, or a strap system incorporated into ski pants or the like to distribute the weight of the snowboard over more of the body of the user, thereby reducing or substantially eliminating the weight applied to the leg to which the snowboard is tethered. In one example of the invention, the strap which supports the snowboard rests on the edge of the chair lift seat and absorbs at least some of the weight of the snowboard, further reducing the force or weight exerted on the body of the user.

The system of the invention may be quickly and easily adjusted to fit different size persons, and includes an adjustable support strap to draw up the snowboard while riding a chair lift, or to lower it during use.

More particularly, an adjustable harness in accordance with one form of the invention includes a relatively wide, padded belt which encircles the waist of the user. The length of the belt may be adjusted by one end which is looped through a quick-connect coupler or buckle at the front of the belt and then secured in adjusted position by suitable fastening means such as Velcro. A Y-shaped strap is attached to the front of the belt on opposite sides of the quick-connect coupling and has a depending end with a quick-connect coupling, to which an elongate, depending support strap is attached through an adjustable connection that permits the length of the support strap to be quickly and easily adjusted. The distal or lower end of the support strap has a connector on it for attachment to a cooperating member on the snow board. The support strap is held in close relationship to one leg of the user by a tether that includes a strap encircling the lower leg of the user and a guide member connected between the encircling strap and the support strap. Suspenders may be attached to the belt and looped over the shoulders of the user to further assist in supporting the weight of the snow board and to distribute the weight between the waist and shoulders of the user.

In use, the support strap is lengthened by adjusting its connection with the Y-strap so that the snow board may be used in a normal manner, with it tethered to the leg of the user by the tether.

When it is desired to ride a chair lift back to the top of a ski slope, the user sits on the chair lift and shortens the length of the support strap by pulling the free end at its adjustable connection with the Y-strap so that the snowboard is lifted up and supported from the waist of the user through the support strap, Y-strap, waist belt and suspenders. In this position, the support strap rests on the front edge of the chair lift, thereby further reducing the weight absorbed or supported by the body of the user.

In another form of the invention, the snowboard support comprises a system of straps including a belt sewn onto the pants (snow pants, ski pants and the like), and an adjustable Y-strap, support strap and tether as described above, to distribute the weight of the snowboard over a large area of the body of the user, and preferably to the waist as in the first form of the invention.

BRIEF DESCRIPTION OF THE DRAWINGS

The foregoing, as well as other objects and advantages of the invention, will become apparent from the following detailed description and accompanying drawings, wherein like reference numerals indicate like parts throughout the several views, and wherein.

BEST MODE FOR CARRYING OUT THE INVENTION

Figure 1:
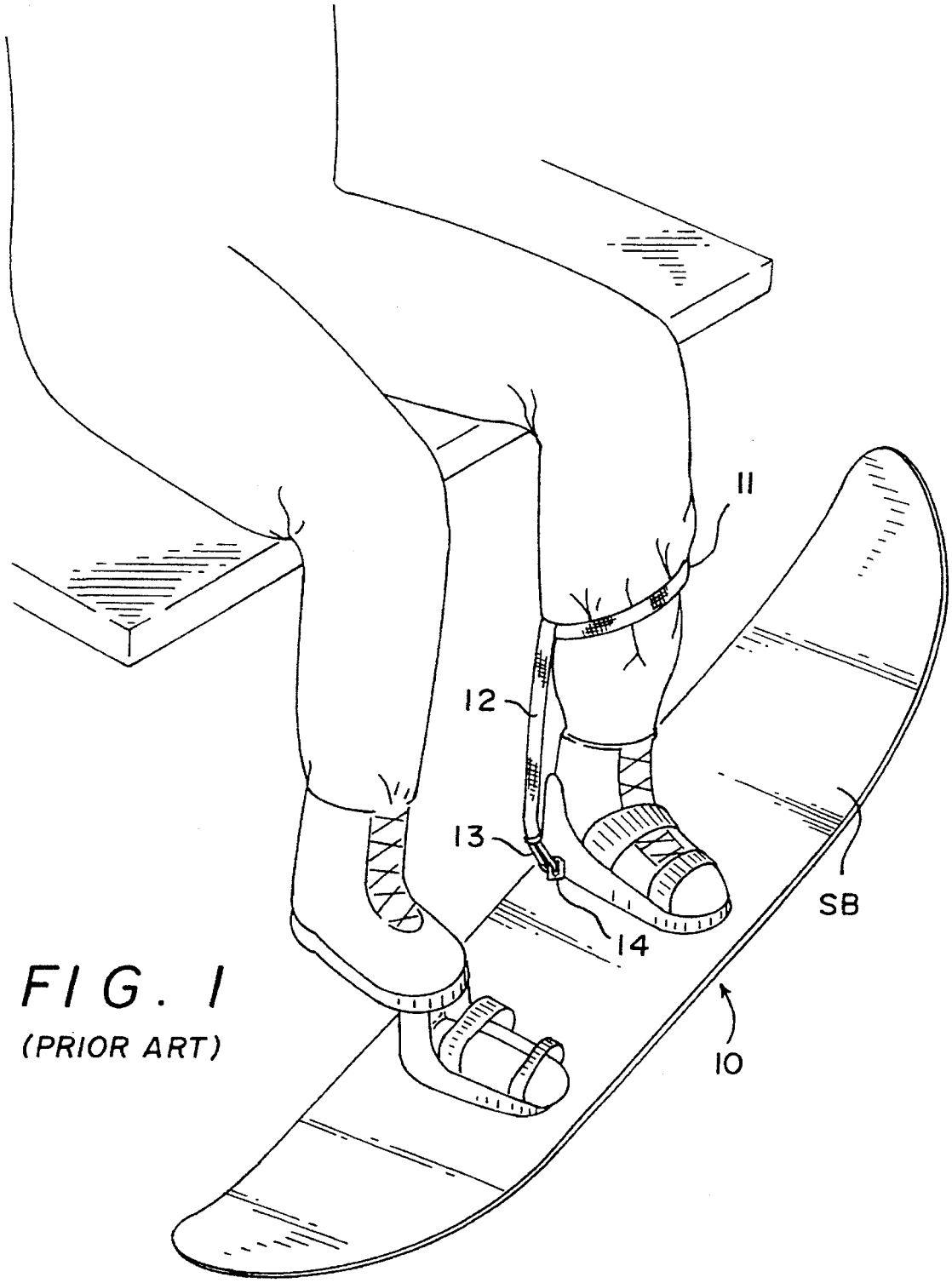
FIG. 1 (PRIOR ART)
FIG. 1 is a fragmentary top perspective view of a conventional snowboard tether, showing how the snowboard is supported from the lower leg of the user.

Referring more particularly to the drawings, a conventional snowboard tether is indicated generally at 10 in FIG. 1. The conventional tether comprises a leg-encircling strap 11 secured around the lower leg of the user, attached to the snowboard SB by a short attaching strap 12 and coupling device 13 which is releasably fastened to a complemental coupling device 14 on the snowboard. As clearly depicted in the drawings, the entire weight of the snowboard is supported from the lower leg of the user, and over a period of time this leads to increased fatigue and reduces the joy of the sport.

Figure 2:
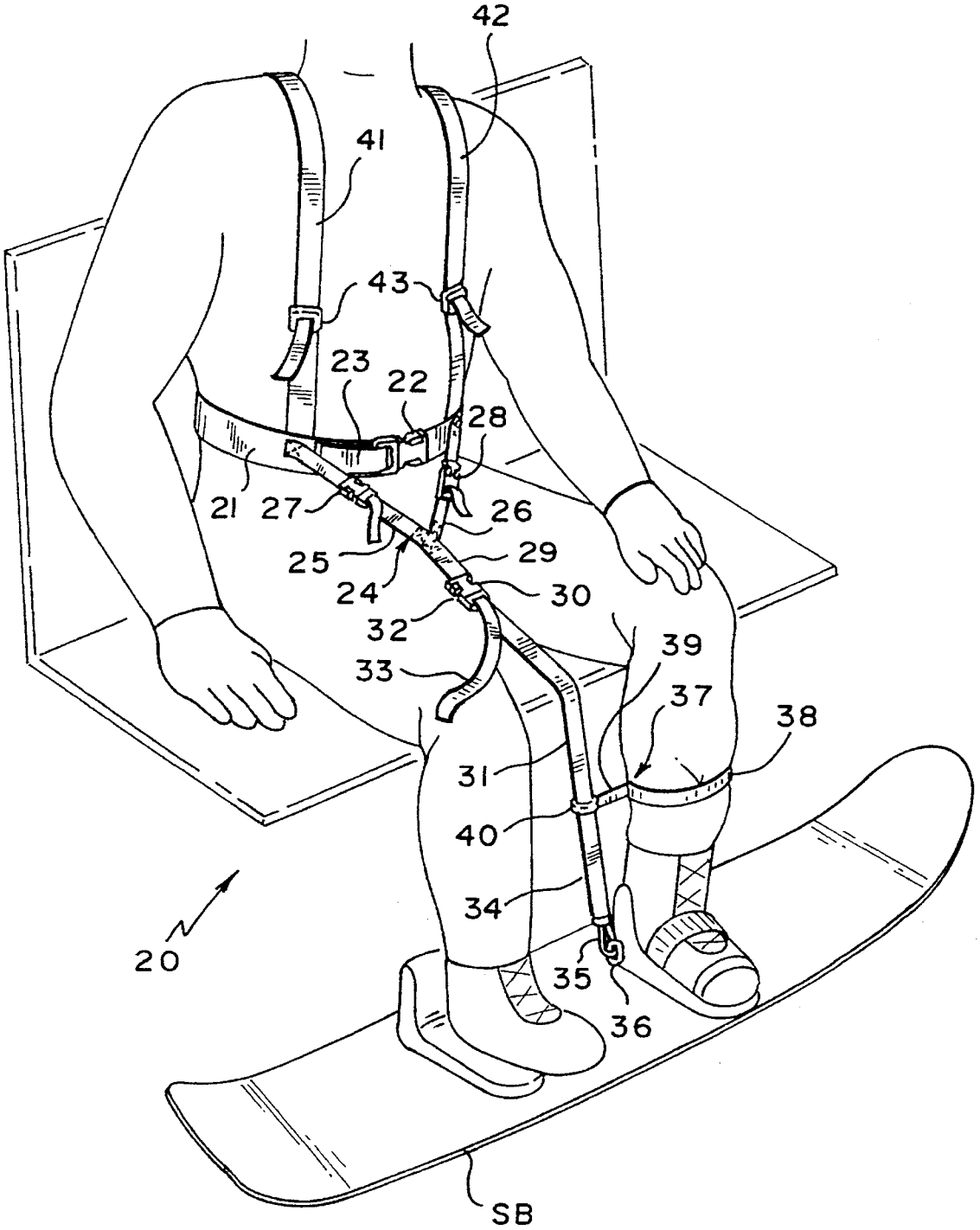
FIG. 2 is a fragmentary top perspective view similar to FIG. 1, showing a first form of snowboard support according to the invention, and illustrating how the snowboard is supported from the waist and shoulders of the user rather from the lower leg as in conventional snowboard tethers.
Figure 4:
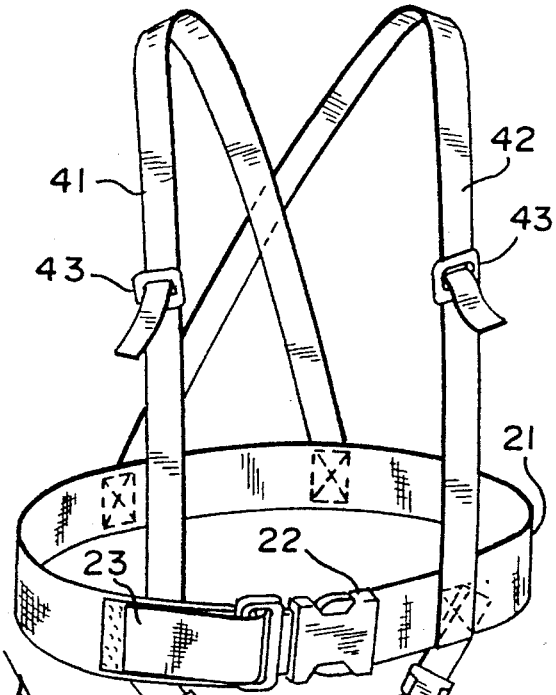
FIG. 4 is a front perspective view of the snowboard support harness according to the first form of the invention.
Figure 3:
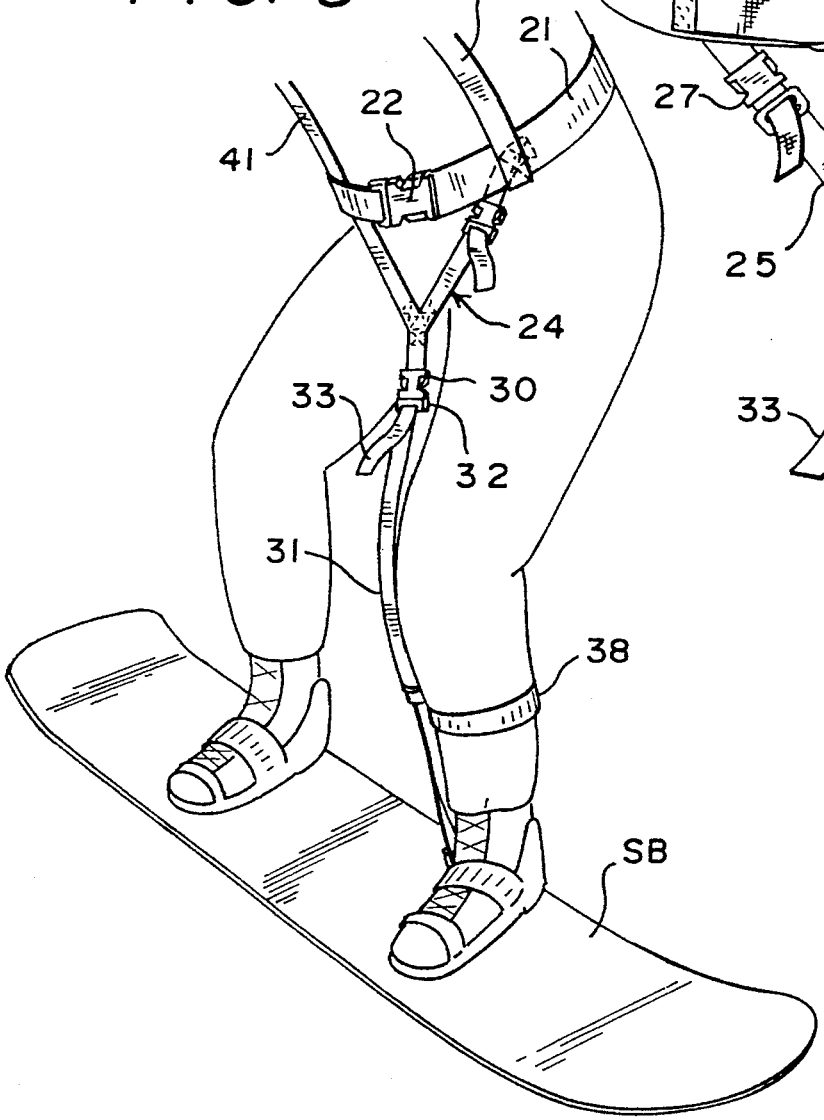
FIG. 3 is a fragmentary top perspective view showing how the snowboard support of the invention enables a user to ride the snowboard unimpaired and in the same manner as with a conventional tether.

In contrast, the snowboard support of the invention, as indicated in a first embodiment generally at 20 in FIGS. 2–4, distributes the weight of the snowboard SB to the waist and shoulders of the user, and even to the seat of the chair lift itself, thereby greatly reducing fatigue and enhancing enjoyment of the sport. In this form of the invention the snowboard support comprises a harness having a waist-encircling belt 21 with a quick-connect coupling or buckle 22 at the front, and an adjustable end 23 that is looped through the connector, folded back upon itself and secured at its free end to the belt by any suitable means, such as Velcro or the like.

A Y-strap 24 has diverging ends 25 and 26 secured via quick-connect couplers 27 and 28, respectively, to the waist belt on opposite sides of the connector 22, and a depending end 29 terminating in a quick-connect coupling 30 that is normally disposed at or slightly below the crotch or groin of the user. The length of the Y-strap may be adjusted by pulling the free ends of the diverging ends 25 and 26 through the respective couplers 27 and 28.

An adjustable support strap 31 is releasably secured by a complemental coupling member 32 at its upper end 33 to the coupling 30, with the upper end looped through the coupling member 32 so that it may be grasped and pulled to draw the strap through the coupling member to shorten it for riding a chair lift or the like. When it is desired to ride the snowboard down a slope, the support strap is again adjusted to an appropriate length to permit the user to ride the snowboard normally. The lower end 34 of the support strap has a quick-clip connector 35 on it for attachment of the support strap to a complemental member 36 on the snowboard. A tether 37 includes a leg-encircling strap 38 and short connecting strap 39 extending between and connected to the strap 38 and a guide member 40 that slides along the support strap 34.

Suspenders 41 and 42 are also preferably attached at their lower ends to the waist belt 21, and are adjustable in length by any suitable means 43, such as conventionally found on suspenders, tie-down straps, webbed belts, or the like. The suspenders distribute part of the weight of the snowboard to the shoulders of the user, rendering it even more comfortable during use.

The straps and clips may be made of nylon or other material suitable for the intended purpose, and are lightweight but strong.

Figure 6:
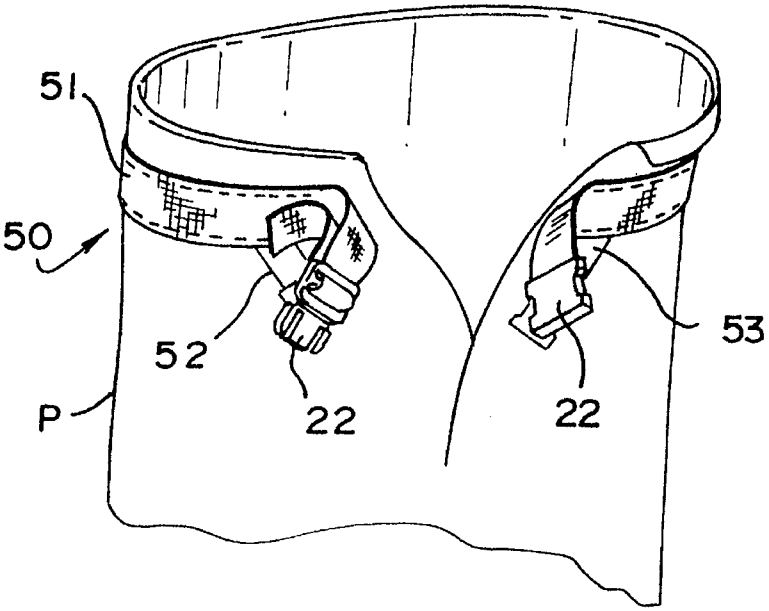
FIG. 6 is a front fragmentary perspective view similar to FIG. 5, showing the waist belt unbuckled.
Figure 5:
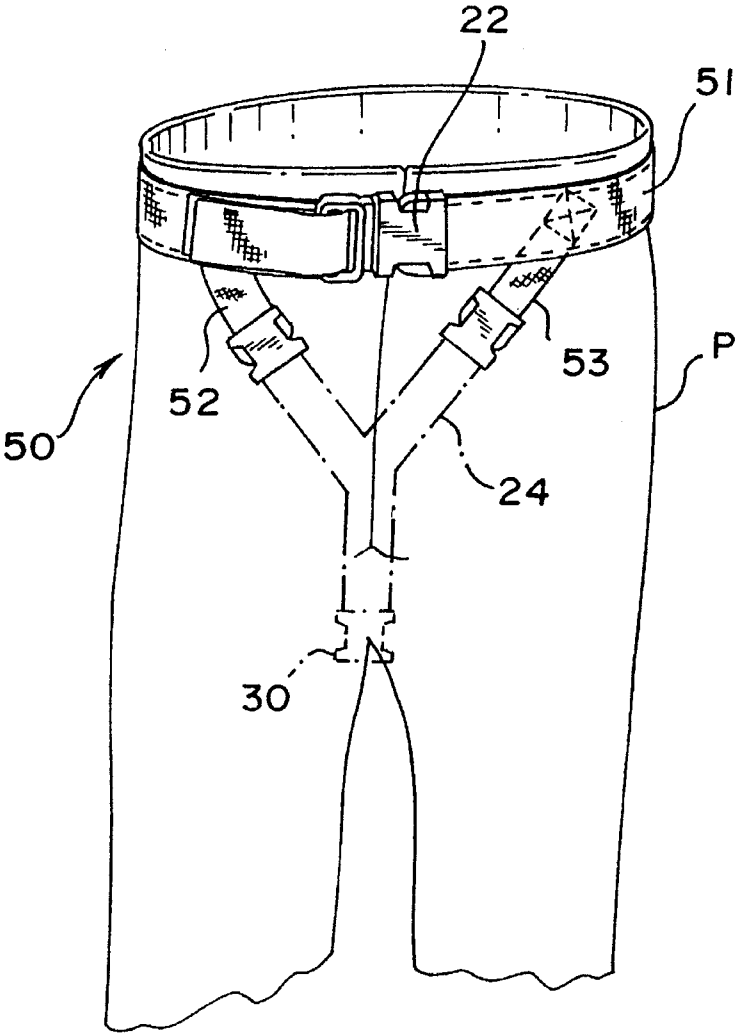
FIG. 5 is a front fragmentary perspective view of a modification of the invention, wherein the waist belt is sewn onto the pants, with two depending connections for the Y-strap.

A further embodiment of the invention is shown at 50 in FIGS. 5 and 6. In this form of the invention, the waist belt 51 is stitched directly onto the ski pants P or the like. Depending connecting straps 52 and 53 are stitched on the waist belt as in the first form of the invention for attaching the Y-strap as previously described, and as shown in dot-and-dashed lines in FIG. 5. Otherwise, this form of the invention is identical to the form previously described.

Although the invention has been illustrated and described in detail herein, it is to be understood that various changes and modifications may be made therein without departing from the spirit and scope of the invention as defined in the appended claims.

What is claimed is:

1. A snowboard support for tethering a snowboard to a leg of a person during use of the snowboard and for supporting the weight of the snowboard when the person is riding a chair lift, comprising:

strap means supported on the body of the user, including a support strap having one end manually releasably connected to the user and another end manually releasably connected to the snowboard for supporting the weight of the snowboard when the user is riding a chair lift, and a tether connected to a leg of the user and to the support strap between the ends of the support strap to tether the snowboard to the user when the snowboard is being ridden.

2. A snowboard support as claimed in claim 1, wherein:

the support strap is adjustable in length so that it may be lengthened to enable the snowboard to be ridden normally during use, and shortened to support the weight of the snowboard while the user is riding a chair lift.

3. A snowboard support as claimed in claim 2, wherein:

the support strap is connected at its said one end to a harness means worn by the user for distributing the weight of the snowboard to an upper body portion of the user when the support strap is adjusted to shorten its length and the user is riding a chair lift.

4. A snowboard support as claimed in claim 3, wherein:

the harness means includes a relatively wide belt that encircles the waist of the user; and said strap means includes a strap connected at one end to the belt at opposite sides of the body of the user and connected at its other end to said one end of the support strap.

5. A snowboard support as claimed in claim 4, wherein:

suspenders are connected to front and back portions of the belt and include portions which extend over the shoulders of the user to assist in supporting and distributing the weight of the snowboard from the waist to the shoulders of the user.

6. A snowboard support as claimed in claim 5, wherein:

the strap connected between the belt and the support strap comprises a Y-strap having diverging upper ends that connect to the belt at respective opposite sides thereof, and a depending strap that connects to said one end of the support strap.

7. A snowboard support as claimed in claim 1, wherein:

the tether comprises a relatively short tether strap connected between the support strap and a lower leg portion of the user.

8. A snowboard support as claimed in claim 7, wherein:

the support strap is releasably connected to the snowboard and to a harness means worn by the user for distributing the weight of the snowboard to an upper body portion of the user when the support strap is adjusted to shorten its length and the user is riding a chair lift; and the connection between the tether strap and the support strap comprises a slidable guide that is free to move along the support strap.

9. A snowboard support as claimed in claim 6, wherein:

the tether comprises a relatively short tether strap connected between the support strap and a lower leg portion of the user.

10. A snowboard support as claimed in claim 9, wherein:

the support strap is releasably connected to the harness means and to the snowboard; and the connection between the tether strap and the support strap comprises a slidable guide that is free to move along the support strap.

11. A snowboard support as claimed in claim 10, wherein:

the lengths of the belt, the diverging ends of the Y-strap and the suspenders are adjustable to adjust the size of the snowboard support to different size persons.

12. A snowboard support as claimed in claim 11, wherein:

the diverging ends of the Y-strap are connected to the belt through a quick-release coupling; and the depending end of the Y-strap is connected to said one end of the support strap through a quick-release coupling.

13. A snowboard support as claimed in claim 3, wherein:

the harness means includes a relatively wide, padded waist belt sewn onto pants worn by the user.

14. A snowboard support as claimed in claim 13, wherein:

a pair of short connecting straps are stitched onto the pants with the waist belt, said connecting straps depending from the waist belt for releasable attachment of a Y-strap; and said support strap being releasably connected to said Y-strap.

15. A snowboard support for tethering a snowboard to a leg of a person during use of the snowboard and for supporting the weight of the snowboard when the person is riding a chair lift, comprising;

a strap means supported on the body of the user, including a support strap having one end connected to the user and at least partially supported from the waist of the user, and another end connected to the snowboard for supporting the weight of the snowboard at least partially from the waist of the user when the user is riding a chair lift, and a tether having one end connected to a leg of the user and another end connected to the support strap between its ends to tether the snowboard to the user when the snowboard is being ridden, said support strap and tether remaining attached to the user and to the snowboard, respectively, during use.

16. A snowboard support as claimed in claim 15, wherein:

the support strap is adjustable in length so that it may be lengthened to enable the snowboard to be ridden normally during use, and shortened to support the weight of the snowboard while the user is riding a chair lift.

17. A snowboard support as claimed in claim 2, wherein:

said support includes a belt worn about the waist of the user, and said strap means includes a strap connected at one end to the belt at opposite sides of the body of the user and connected at its other end to said one end of the support strap.

18. A snowboard support as claimed in claim 17, wherein:

the strap means connected between the belt and the support strap comprises a Y-strap having diverging upper ends that connect to the belt at respective opposite sides thereof, and a depending strap that connects to said one end of the support strap.

19. A snowboard support as claimed in claim 15, wherein:

the tether comprises a relatively short tether strap connected between the support strap and a lower leg portion of the user.

20. A snowboard support as claimed in claim 17 wherein:

said belt is stitched to plants worn by the user.

* * * * *